US005775212A

United States Patent [19]

Takao

[11] Patent Number: 5,775,212

[45] Date of Patent: Jul. 7, 1998

[54] GUIDE GIB STRUCTURE FOR PRESS SLIDE OF MECHANICAL PRESS FOR METAL WORKING

[75] Inventor: Hiromichi Takao, Seto, Japan

[73] Assignee: Asahi-Seiki Manufacturing Co., Ltd., Aichi-ken, Japan

[21] Appl. No.: 663,877

[22] Filed: Jun. 19, 1996

[30] Foreign Application Priority Data

Aug. 31, 1995 [JP] Japan ..... 7-248856

[51] Int. Cl.[6] ..... B30B 15/04

[52] U.S. Cl. ..... 100/214; 72/456; 384/39

[58] Field of Search ..... 100/214; 72/456; 384/13, 39, 40

[56] References Cited

U.S. PATENT DOCUMENTS

| | | | |
|---|---|---|---|
| 1,653,030 | 12/1927 | Zeh | 100/214 |
| 2,321,741 | 6/1943 | Flowers | 384/39 |
| 2,581,022 | 1/1952 | Japikse | 100/214 |
| 2,914,362 | 11/1959 | Ott et al. | 384/40 |
| 3,902,347 | 9/1975 | Ridgway et al. | 100/214 |

FOREIGN PATENT DOCUMENTS

| | | | |
|---|---|---|---|
| 2409036 | 10/1974 | Germany | 100/214 |
| 37-24559 | 9/1961 | Japan . | |
| 53-30199 | 3/1978 | Japan . | |
| 460194 | 4/1975 | U.S.S.R. | 100/214 |

*Primary Examiner*—Stephen F. Gerrity
*Attorney, Agent, or Firm*—Oliff & Berridge, P.L.C.

[57] ABSTRACT

A guide gib 3 is mounted on a upright 2 in such a manner that an inclined sliding surface 1*b* of a slide 1 is in sliding contact with an inclined guide surface 3*a* of the guide gib 3. Inclined surfaces 3*f* are formed in a rear surface 3*c* of the guide gib 3, and are spaced from each other along a longitudinal direction thereof, the inclined surfaces 3*f* extended along the longitudinal direction of the guide gib 3. Each of wedge blocks 6 has a wedge inclined surface 6*a* in contact with a corresponding one of the inclined surfaces 3*f*. The wedge block 6 is moved by a set screw 7 and a nut 8 so as to fix the position of acting of the wedge inclined surface 6*a* by a flange 7*b* of the set screw 7 and the nut 8, thereby adjusting a clearance between the inclined guide surface 3*a* of the guide gib 3 and the inclined sliding surface 1*b* of the slide 1, and then the guide gib 3 is fixed to the uprights 2 by a plurality of fastening bolts 9.

1 Claim, 5 Drawing Sheets

GUIDE GIB STRUCTURE FOR PRESS SLIDE OF MECHANICAL PRESS FOR METAL WORKING

BACKGROUND OF THE INVENTION

1. Field of the Invention

This invention relates to a guide gib structure for a press slide of a mechanical press for metal working of the type in which the press slide is reciprocally moved vertically (that is, upward and downward) along a pair of parallel spaced, opposed uprights in a space between these uprights of frame (not shown).

2. Description of the Related Art

In such mechanical press for metal working a pair of slide guides are provided at each of front and rear sides of the mechanical press for metal working, and are mounted respectively on a pair of opposed uprights to extend in a direction of movement of a press slide. The press slide is reciprocally moved vertically while guided by these slide guides. The pair of slide guides, which is provided at any one of the front and rear sides of the mechanical press for metal working, can be adjusted in position so that they are movable back and forth in a direction perpendicular to the direction of movement of the press slide. That is, in a direction of the depth of the mechanical press for metal working. These slide guides whose position can be adjusted are commonly referred to as "guide gib".

FIG. 5 is a transverse cross-sectional view of one such conventional guide gib in a plane perpendicular to a direction of movement of a press slide. In FIG. 5, the guide gib 102 of a triangular cross-section is positioned in a space of a triangular cross-section defined by two surfaces 103*a* and 103*b* of a frame 103 and an inclined sliding surface 101*a* of the press slide 101. Assuming that a direction of the depth of a mechanical press for metal working is represented by an X-axis while a direction of the width thereof perpendicular to this depthwise direction is represented by a Y-axis, the guide gib 102 has an inclined guide surface 102*a* in sliding contact with the inclined sliding surface 101*a*, and this inclined guide surface 102*a* is inclined at an angle of about 60° with respect to the X-axis. A plurality of set screws 104 are mounted on the upright 103 in perpendicular relation to a surface 102*b* of the guide gib 102. The set screws 104 move the guide gib 102 in the Y-axis direction, thereby adjusting a clearance or gap between the inclined sliding surface 101*a* of the press slide 101 and the inclined guide surface 102*a* of the guide gib 102, and then the guide gib 102 is fixed to the upright 103 by fastening bolts 105. In this guide gib structure, the bearing pressure of those portions (bearing portions) of the surface 102*b* of the guide gib 102 against which the set screws 104 abut, respectively, is higher than the bearing pressure of the remainder of the surface 102*b*, and therefore each of these bearing portions is liable to become a non-flat surface including many pits and projections, and besides there is encountered a problem that the fastening bolts 105 are liable to become loosened. A further problem is that since the amount of movement (that is, the amount of adjustment) of the guide gib 102 is limited by the lead angle of the set screws 104, it is difficult to achieve fine adjustment of the guide gib 102.

SUMMARY OF THE INVENTION

It is therefore an object of this invention to provide a guide gib structure for a press slide in a mechanical press for metal working, in which the position of the guide-gib can be easily adjusted, and an inclined guide surface of the guide gib in contact with a sliding surface of a press slide will not be deformed by an eccentric load applied thereto.

According to the present invention, there is provided a guide gib structure for slide guides in a mechanical press for metal working in which a press slide is reciprocally moved vertically by a drive source along a pair of parallel spaced, opposed uprights in a space formed between the uprights;

wherein a pair of the slide guides are provided at each of front and rear sides of the mechanical press for metal working, respectively, and are mounted respectively on the pair of opposed uprights to extend in a direction of movement of the press slide, and the pair of slide guides which is provided at one of the front and rear sides of the mechanical press for metal working, constitutes a pair of guide gibs, respectively, which is movable back and forth in a direction perpendicular to the direction of movement of the press slide so that their position can be adjusted;

wherein each of the guide gibs has an inclined guide surface (first inclined surface) in contact with a sliding surface of the press slide, and assuming that a direction of a depth of the mechanical press for metal working is represented by an X-axis while a direction of a width thereof perpendicular to this widthwise direction is represented by a Y-axis, the first inclined guide surface is inclined with respect to the X-axis and the Y-axis in a horizontal cross-section of the guide gib;

wherein the guide gib is fixed to the upright in such a manner that the position of the guide gib can be adjusted in the X-axis direction;

wherein wedge blocks are mounted on each of the two uprights corresponding to at least two positions in a longitudinal direction of the guide gib so as to adjust the position of the guide gib;

wherein the wedge block is movable back and forth in the Y-axis direction, and can be fixed at an arbitrary position, and a side surface of the wedge block in contact with the guide gib is formed as a wedge inclined surface, and a side surface of the guide gib, engaging the wedge inclined surface, is formed as an inclined surface (second inclined surface); and wherein the position of the guide gib in the Y-axis direction is determined by the relation of engagement between the second inclined surface and the wedge inclined surface.

DESCRIPTION OF THE PREFERRED EMBODIMENT

A preferred embodiment of the present invention will now be described with reference to the drawings.

Figure 1:
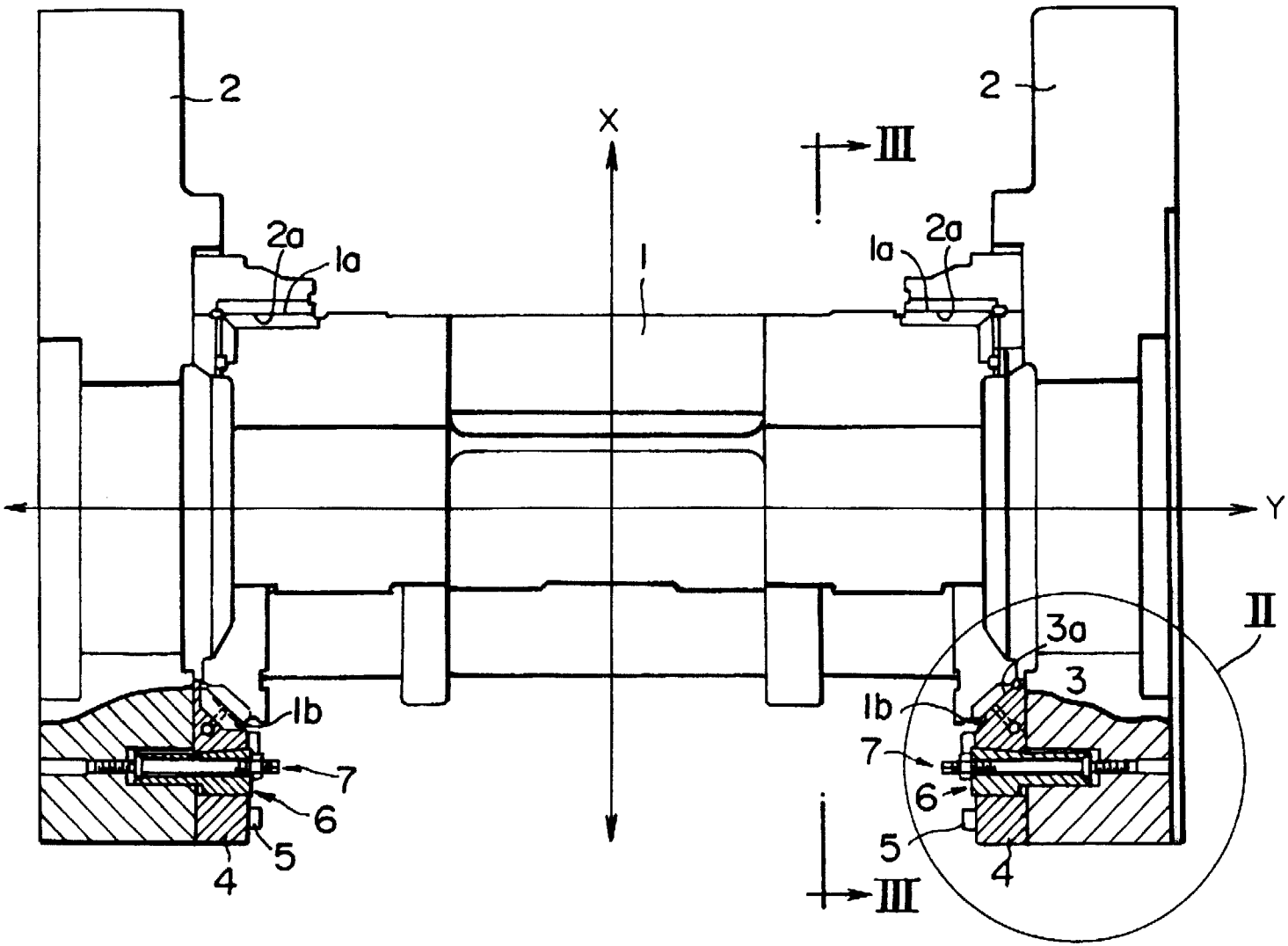
FIG. 1 is a cross-sectional view of a mechanical press for metal working, showing a horizontal cross-section of slide guides.

FIG. 1 is a cross-sectional view showing the cross-section of slide guide assemblies of a mechanical press for metal working. A pair of slide guides are provided at each of front and rear sides of the mechanical press for metal working, and are mounted respectively on a pair of opposed uprights 2 to extend in a direction of movement of a slide 1. The slide 1 is driven by a drive source (not shown) to reciprocally move vertically (that is, upward and downward) along the pair of parallel spaced, opposed uprights 2 and 2 in a space between the pair of uprights 2 and 2. A pair of L-shaped sliding surfaces 1*a* and 1*a* are formed respectively at opposite corner portions of the slide 1 at the rear side of the mechanical press for metal working. A pair of inclined sliding surfaces 1*b* and 1*b* are formed respectively at opposite corner portions of the slide 1 at the front side of the mechanical press for metal working. Assuming that a direction of the depth of the mechanical press for metal working is represented by an X-axis while a direction of the width thereof perpendicular to this depthwise direction is represented by a Y-axis, the inclined sliding surface 1*b* is inclined at an angle of about 45° with respect to the X-axis in a horizontal cross-section of the guide gib. The pair of slide guides which is provided at the rear side of the mechanical press for metal working, has L-shaped guide surfaces 2*a* and 2*a*, respectively, which is in sliding contact with the L-shaped sliding surfaces 1*a* and 1*a* of the slide 1, respectively. The pair of slide guides (guide gibs) 3 which is provided at the front side of the mechanical press for metal working, has inclined guide surfaces 3*a* and 3*a*, respectively, which is in sliding contact with the inclined sliding surfaces 1*b* and 1*b* of the slide 1, respectively. A clearance or gap between the inclined guide surface 3*a* of each guide gib 3 and the inclined sliding surface 1*b* of the slide 1 can be adjusted.

Figure 2:
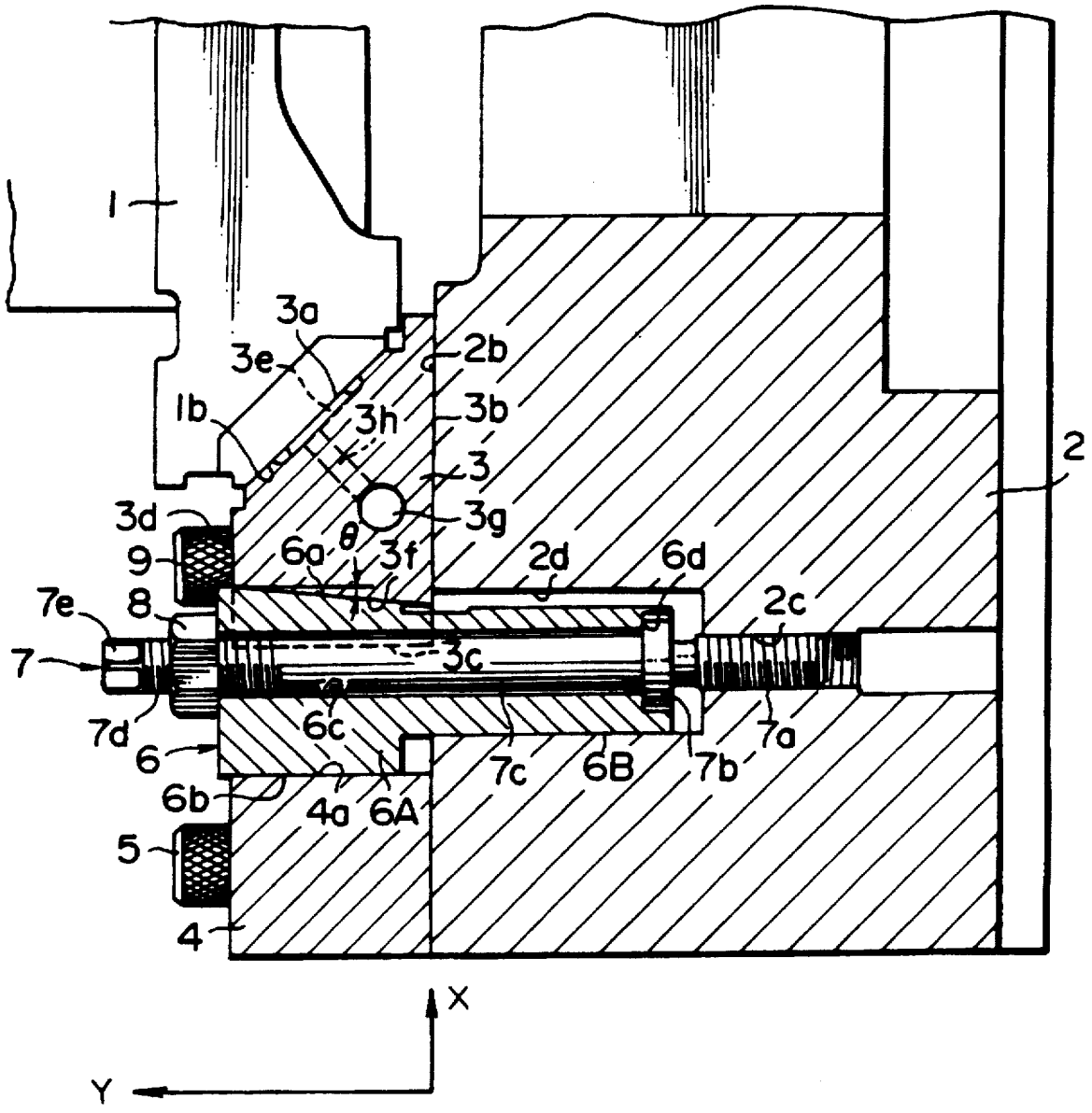
FIG. 2 is an enlarged view of a portion encircled as at II in FIG. 1.
Figure 3:
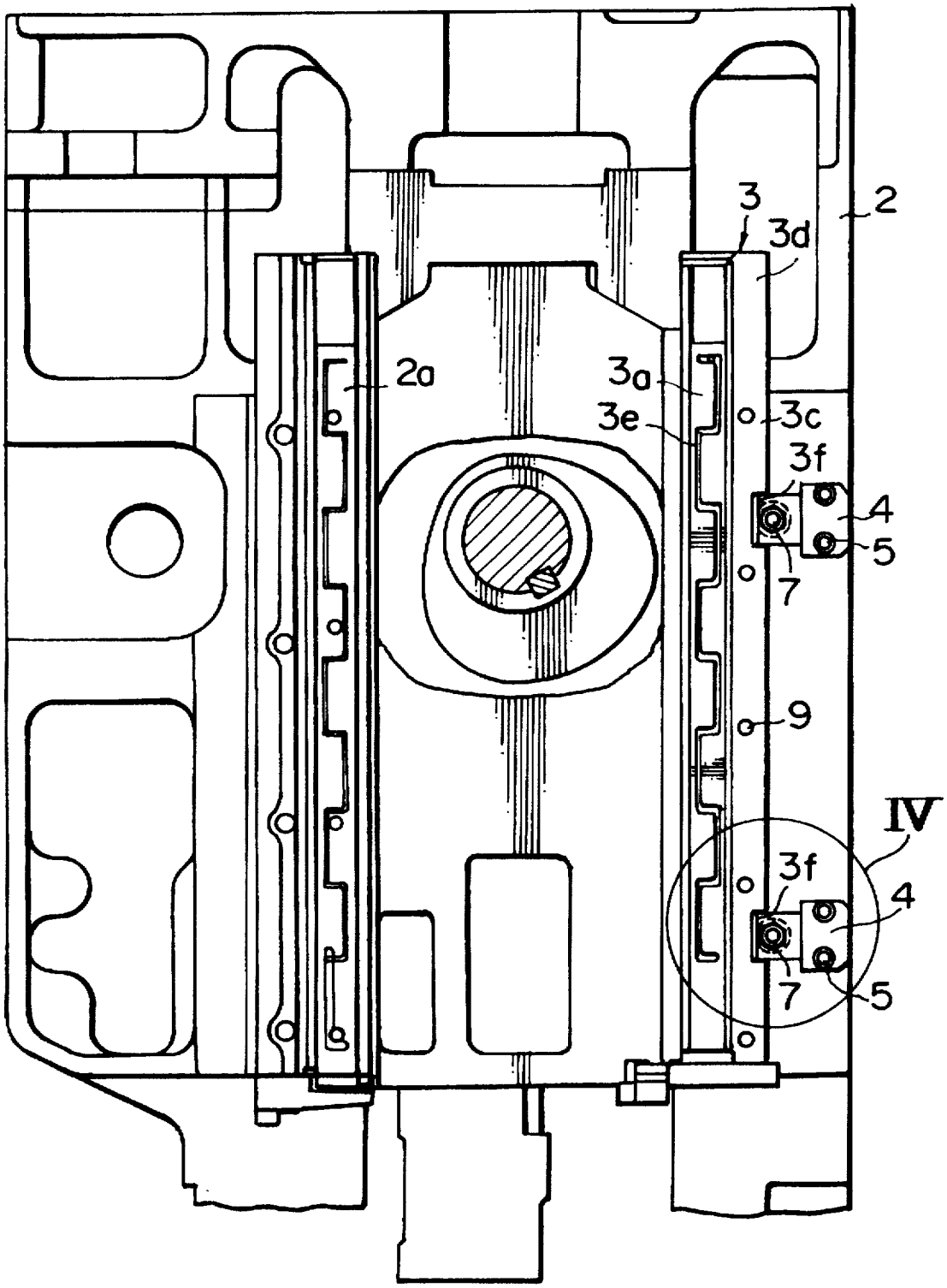
FIG. 3 is a side-elevational view as seen from the line III—III of FIG. 1, with a press slide omitted for better understanding of the guide gibs.
Figure 4:
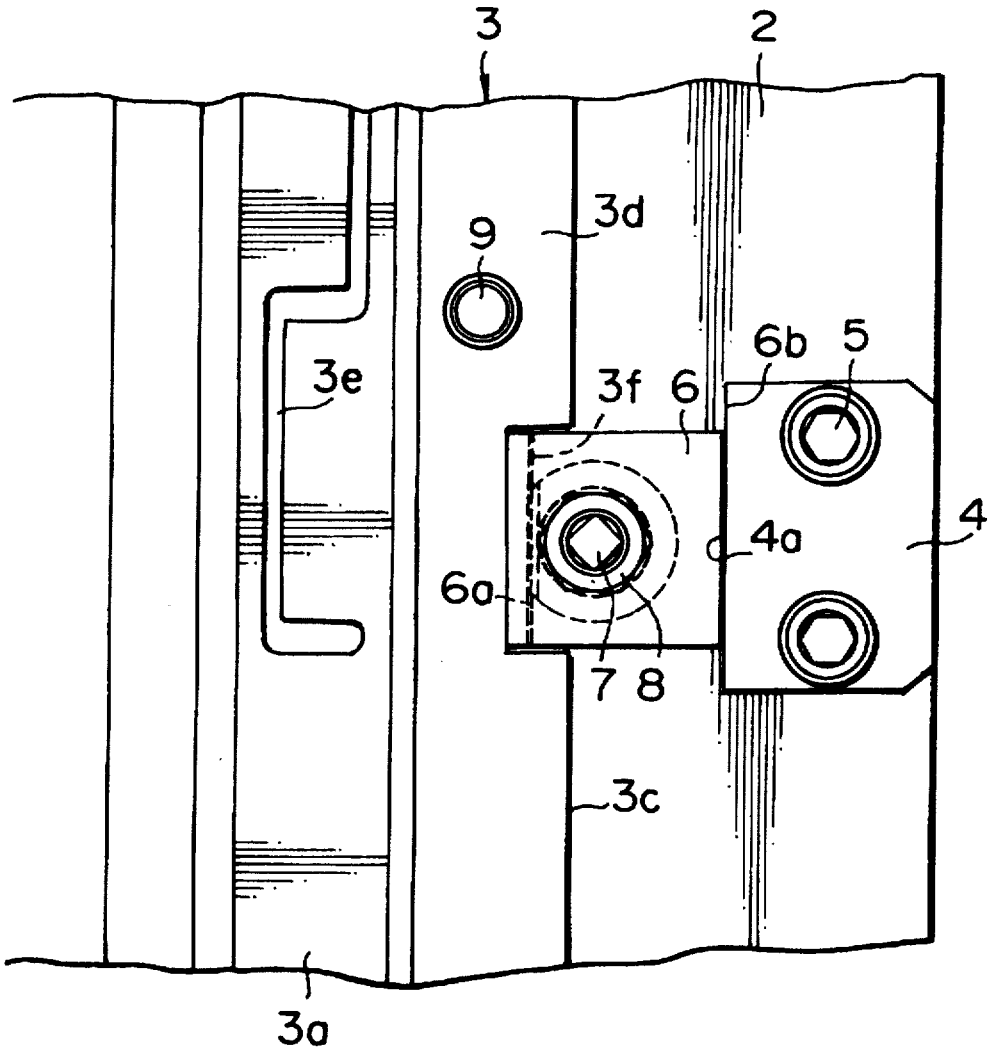
FIG. 4 is an enlarged view of a portion encircled as at IV in FIG. 3.
Figure 5:
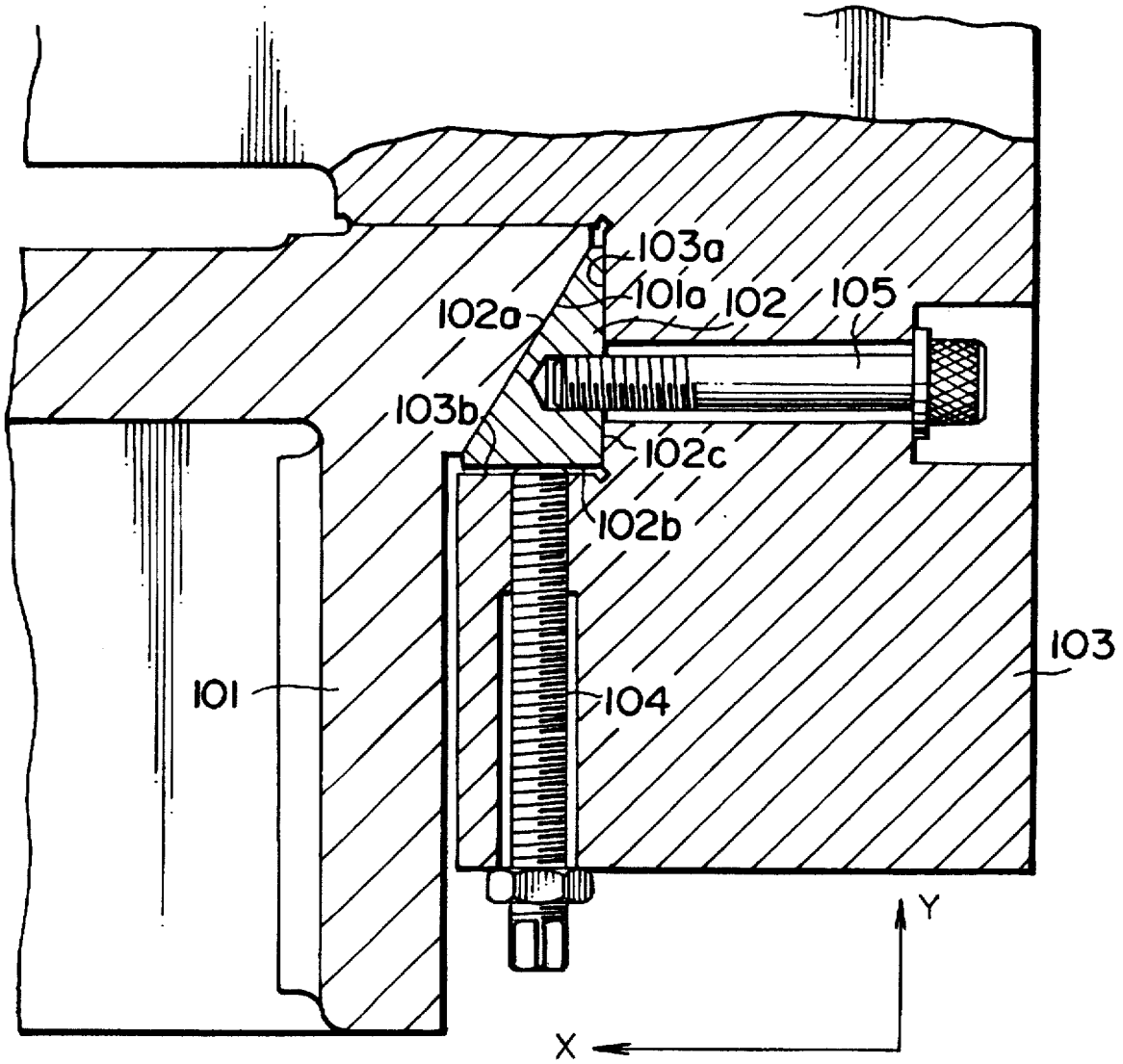
FIG. 5 PRIOR ART
FIG. 5 is a view showing a conventional guide gib structure for a mechanical press for metal working.

As shown on an enlarged scale in FIG. 2, the guide gib 3 has the inclined guide surface 3*a* in sliding contact with the inclined sliding surface 1*b* of the slide 1. The guide gib 3 is in the form of a relatively thick bar of a polygonal transverse cross-section having the inclined guide surface 3*a*, a first rear surface 3*b*, a second rear surface 3*c* disposed perpendicular to the first rear surface 3*b*, and a surface 3*d* disposed parallel to the first rear surface 3*b*. An oil groove 3*e* is formed in the inclined guide surface 3*a*, and communicates with an oil hole 3*g* through an oil hole 3*h* (see FIGS. 2 to 4). The first rear surface 3*b* of the guide gib 3 is held against a side surface 2*b* of the upright 2. A plurality of (two in this embodiment) inclined surfaces 3*f* are formed in the second rear surface 3*c* of the guide gib 3, and are spaced from each other along a longitudinal direction of the guide gib 3, each of these inclined surfaces 3*f* being inclined at a predetermined angle with respect to the X-axis. The inclined surfaces 3*f* extend along the longitudinal direction of the guide gib 3. Backup blocks 4 each fixedly secured by two bolts 5 to the upright 2 are disposed on the side of the inclined surfaces 3*f*, respectively. A hole 2*d* is formed in that portion of the side surface 2*b* of the uprights disposed between each of inclined surfaces 3*f* and the backup block 4, and a threaded hole 2*c* further extends from an inner end of the hole 2*d*, the hole 2*d* and the threaded hole 2*c* extending perpendicular to the side surface 2*b*.

A wedge block 6 includes a square head 6A and a cylindrical shank 6B extending from the square head 6A. The square head 6A has a wedge inclined surface 6*a* for contacting with the inclined surface 3*f* of the guide gib 3, and an abutment surface 6*b* for contacting with a side surface 4*a* of the backup block 4. The wedge inclined surface 6*a* has the same inclination as that of the inclined surface 3*f*. The cylindrical shank 6B is inserted in the hole 2*d* in the uprights for movement in the Y-axis direction, and in this condition the wedge inclined surface 6*a* is held against the inclined surface 3*f*, and also the abutment surface 6*b* is held against the side surface 4*a*. A central hole or bore 6*c* is formed axially through the wedge block 6, and a counterbore 6*d* is formed in a distal end face of the cylindrical shank 6B. A set screw 7 is slightly loosely inserted in the central hole 6*c*. A threaded portion 7*a* for being threaded into the threaded hole 2*c* in the uprights is formed at a distal end portion of the set screw 7. A flange 7*b* for being tightenly fitted in the counterbore 6*d* is formed on the set screw 7, and is disposed rearwardly of the threaded portion 7*a*, and the set screw 7 has a stud 7*c* extending rearwardly from the flange 7*b*. Further, the set screw 7 has a threaded portion 7*d* extending rearwardly from the stud 7*c*, and an across flat 7*e* is formed at a proximal end of the set screw 7. A nut 8 is adapted to be fitted on that portion of the threaded portion 7*d* extending outwardly from the central hole 6*c*.

The angle θ of inclination with reference to the Y-axis of each of the inclined surfaces 3*f* which are formed on the gib 3, and the wedge inclined surface 6*a* of the wedge block 6 is in the range of from 4° to 10°, and preferably in the range of from 50° to 60°. The position of acting of the wedge inclined surface 6*a* of the wedge block 6 is determined by the position of the flange 7*b* of the set screw 7 in the Y-axis direction. Namely, by tightening the nut 8, the wedge block 6 is firmly held between the inner end surface of the nut 8 and the outer end surface of the flange 7*b*.

When the wedge block 6 is moved, for example, in such a direction that the wedge inclined surface 6*a* acts on the guide gib 3, the guide gib 3 is moved in the X-axis direction by the wedge inclined surface 6*a*. In accordance with this movement, the clearance between the inclined sliding surface 1*b* of the slide 1 and the inclined guide surface 3*a* of the guide gib 3 is gradually reduced. Thus, this clearance can be adjusted to the optimum level by the set screw 7 and the nut 8. After the clearance is thus adjusted to the optimum level, the gib 3 is fixed to the side surface 2*b* by a plurality of fixing bolts 9.

For adjusting the guide gib 3, the nut 8 is kept in a loosed condition, and in this condition the threaded portion 7*a* of the set screw 7 is screwed into the deepest portion of the threaded hole 2*c*. Then, the nut 8 is slightly fitted on the threaded portion 7*d* of the set screw 7 to push the wedge block 6. The nut 8 is rotated right until the wedge block 6 and the guide gib 3 abut with each other and the tightening force of the nut 8 increases, and then the nut 8 is held against movement by the hand or a spanner, and then a spanner is engaged with the across flat 7*e* of the set screw 7, and is rotated left (that is, in a counterclockwise direction). As a result of this counterclockwise rotation of the set screw 7, the flange 7*b* is moved toward the wedge block 6, so that the outer end surface of the flange 7*b* is brought into contact with the bottom surface of the counterbore 6*d*, and therefore the fastening force of the set screw 7 is increased. In this manner, the plurality of set screws 7 are provisionally adjusted, and the clearance between the inclined sliding surface 1*b* of the slide 1 and the inclined guide surface 3*a* of the guide gib 3 is measured. If this measured value of the clearance is smaller than a predetermined value, the nut 8 is slightly loosened, and the set screw 7 is rotated left, so that the flange 7*b* fastens the wedge block 6 to move the same, and the wedge block 6 is clamped in position. In contrast, if the measured value of the clearance is larger than the predetermined value, the set screw 7 is rotated right (clockwise), so that the nut 8 fastens the wedge block 6 to move the same, and the wedge block 6 is clamped in position. This operation is carried out several times, and after the clearance is adjusted to the predetermined value, the guide gib 3 is fixed to the uprights 2 by tightening the plurality of bolts 9. The guide gib 3 is a relatively thick bar of a polygonal cross-section, and therefore when the clearance is adjusted at the two regions spaced from each other along a longitudinal direction of the guide gib 3, any non-flat surface including many pits and projections will not be produced. In the case of a large-size mechanical press for metal working having long guide surfaces, the number of the wedge blocks 6 is increased.

What is claimed is:

1. A guide gib structure for slide guides in a mechanical press for metal working in which a press slide is reciprocally moved vertically by a drive source along a pair of parallel spaced, opposed uprights in a space between said uprights, and a direction of a depth of the mechanical press for metal working being represented by an X-axis while a direction of a width thereof perpendicular to the depthwise direction being represented by a Y-axis;

wherein a pair of said slide guides are provided at each of front and rear sides of the mechanical press for metal working, respectively, and are mounted respectively on said uprights to extend in a direction of movement of the press slide, and said pair of slide guides which is provided at one of the front and rear sides of the mechanical press for metal working, constitutes a pair of guide gibs, said guide gibs being movable back and forth in a direction perpendicular to the direction of movement of the press slide so that their position can be adjusted;

wherein each of said guide gibs has a first inclined guide surface in contact with a sliding surface of the press slide, said first inclined guide surface being inclined with respect to said X-axis and said Y-axis in a horizontal cross-section of said guide gibs;

wherein each of said guide gibs is fixed along a surface of said uprights in such a manner that the position of said guide gibs can be adjusted in said X-axis direction;

wherein wedge blocks are mounted on said uprights corresponding to at least two positions in a longitudinal direction of each of said guide gibs so as to adjust the position of each of said guide gibs;

wherein each of said wedge blocks is movable back and forth in said Y-axis direction, and can be fixed at an arbitrary position, and a side surface of each of said wedge blocks in contact with each of said guide gibs is formed as a wedge inclined surface, and a side surface of each of said guide gibs, engaging said wedge inclined surface, is formed as a second inclined surface;

wherein each of said wedge blocks, except a head portion thereof having a wedge effect, is received in a hole formed in said uprights so that each of said wedge blocks can be movable in said Y-axis direction, a set screw has a flange for determining the position of a distal end of each of said wedge blocks in said Y-axis direction and extends through each of said wedge blocks for rotation and axial movement, said set screw is screwed into a threaded hole extending axially from said hole in said uprights, a nut is fitted on a threaded head portion of said set screw, and the position of each of said wedge blocks in said Y-axis direction is determined by the position of said nut in a longitudinal direction of said set screw and the position of said flange in said Y-axis direction so as to determine the position of said wedge inclined surface of each of said wedge blocks; and wherein the position of each of said guide gibs in said X-axis direction is determined by the engagement between said second inclined surface and said wedge inclined surface.

* * * * *